US005673485A

United States Patent [19]

Hill

[11] Patent Number: 5,673,485

[45] Date of Patent: Oct. 7, 1997

[54] SAFETY RAZORS

[76] Inventor: John Hill, P.O. Box 1698, Georgetown, Cayman Islands

[21] Appl. No.: 531,096

[22] Filed: Sep. 20, 1995

Related U.S. Application Data

[63] Continuation of Ser. No. 371,455, Jan. 11, 1995, abandoned, which is a continuation of Ser. No. 60,950, May 12, 1993, abandoned.

[30] Foreign Application Priority Data

May 12, 1992 [GB] United Kingdom ..... 9210150

[51] Int. Cl.[6] ..... B26B 21/22; B26B 21/44; B26B 21/52

[52] U.S. Cl. ..... 30/41.5; 30/50; 30/57; 30/531; 30/535

[58] Field of Search ..... 30/41, 41.5, 50, 30/57, 86, 87, 88, 123.3, 531, 535

[56] References Cited

U.S. PATENT DOCUMENTS

| | | | |
|---|---|---|---|
| 3,412,465 | 11/1968 | Andersen | 30/41 |
| 3,726,009 | 4/1973 | Hackmyer | 30/41 |
| 4,228,586 | 10/1980 | Thierry | 30/41 |
| 4,377,034 | 3/1983 | Druash et al. | 30/41 |
| 4,809,432 | 3/1989 | Schauble | 30/41 |
| 4,977,669 | 12/1990 | Clifford | 30/41 |
| 4,993,153 | 2/1991 | Henry | 30/50 |
| 5,033,152 | 7/1991 | Althaus | 30/57 X |

*Primary Examiner*—Rinaldi I. Rada
*Assistant Examiner*—Raymond D. Woods
*Attorney, Agent, or Firm*—R. Winston Slater

[57] ABSTRACT

A safety razor has a handle, a head on the handle on which a razor blade or blade holder is mountable, a reservoir for water or other suitable lubricating liquid for shaving and an outlet for supplying the liquid from the reservoir to the blade, whereby the liquid is available for the skin during shaving.

7 Claims, 9 Drawing Sheets

SAFETY RAZORS

This application is a continuation of application Ser. No. 08/371,455, filed Jan. 11, 1995, abandoned, which is a continuation of Ser. No. 08/060,950, filed May 12, 1993, abandoned.

BACKGROUND OF THE INVENTION

This invention concerns improvements in and relating to safety razors.

Safety razors are generally recommended to be used with plenty of water to minimize damage to the skin which can result in soreness and, of course stinging when after-shave lotions and the like are applied. However, it is extremely tedious either to have to keep dipping the razor in water or to have to keep splashing water onto the face.

An object of this invention is to provide a safety razor that may overcome the above-mentioned disadvantage.

According to one aspect of the invention there is provided a safety razor having a handle, a head on the handle on which a razor blade or a blade holder is mountable, a reservoir for water or other suitable lubricating liquid for shaving and means for supplying said liquid from the reservoir to said blade, whereby said liquid is available for the skin during shaving.

In one preferred embodiment of the invention, the reservoir may be separate from the handle of the safety razor, for example as a reservoir connected to the razor say by flexible tubing. The reservoir will need to be above the shaving height if gravity feed is to be relied upon for delivering liquid to the razor. In a preferred embodiment the handle of the razor may have a hollow section to which the tubing is connected, the hollow section leading to the razor blade(s) via, if necessary, an attachment head for a razor blade holder. The reservoir preferably has an on/off tap. Additionally or alternatively flow restriction means may also provided for the tubing.

In another preferred embodiment of the invention, the reservoir may be separable from the handle of the safety razor and itself may provide the means for attachment of a razor blade or razor blade holder.

In yet another preferred embodiment of the invention the reservoir may be formed in or integrally with the handle of the safety razor.

The preferred safety razors of the invention will permit orientation of the blade or blades thereof relative to the handle for reversal for "down" and "up" shaving strokes.

The blade holder may be adapted for removal and replacement at 180° to its original position. Possibly the blade holder may be a sliding fit with mutually engageable parts of a head of the handle of the razor. Alternatively the blade holder or a part to which it is attached may be rotatable whereby the blade orientation relative to the handle may be altered through 180°.

The preferred safety razors of the invention are arranged so that gravity will feed liquid to the blade(s) thereof. However, the reservoir may be squeezable to facilitate liquid flow or may be provided with pump means for facilitating liquid flow.

In essence, therefore, the invention aims to provide water or other suitable lubricating liquid to the face in the region of the shaving stroke via a safety razor itself.

According to a second aspect of this invention there is provided a safety razor having a handle, a head on the handle on which a razor blade or a blade holder is mountable wherein said head is reciprocally movable relative to the handle.

Preferably the head is spring loaded so as to be normally urged away from the handle but is urgeable towards the handle upon application of pressure thereto, such as during the shaving action.

The movement of the head relative to the handle may be used to emit lubricating liquid in accordance with the first aspect of the invention. Thus, the movement of the head towards the handle may bring into line an aperture associated with the head and an opening of a liquid supply means, whereby liquid can travel from the supply means to the head and hence to a blade or blades on the head.

This invention will now be further described, by way of example only, with reference to the accompanying drawings, in which:

DESCRIPTION OF THE PREFERRED EMBODIMENT

Figures 1, 2, 3:
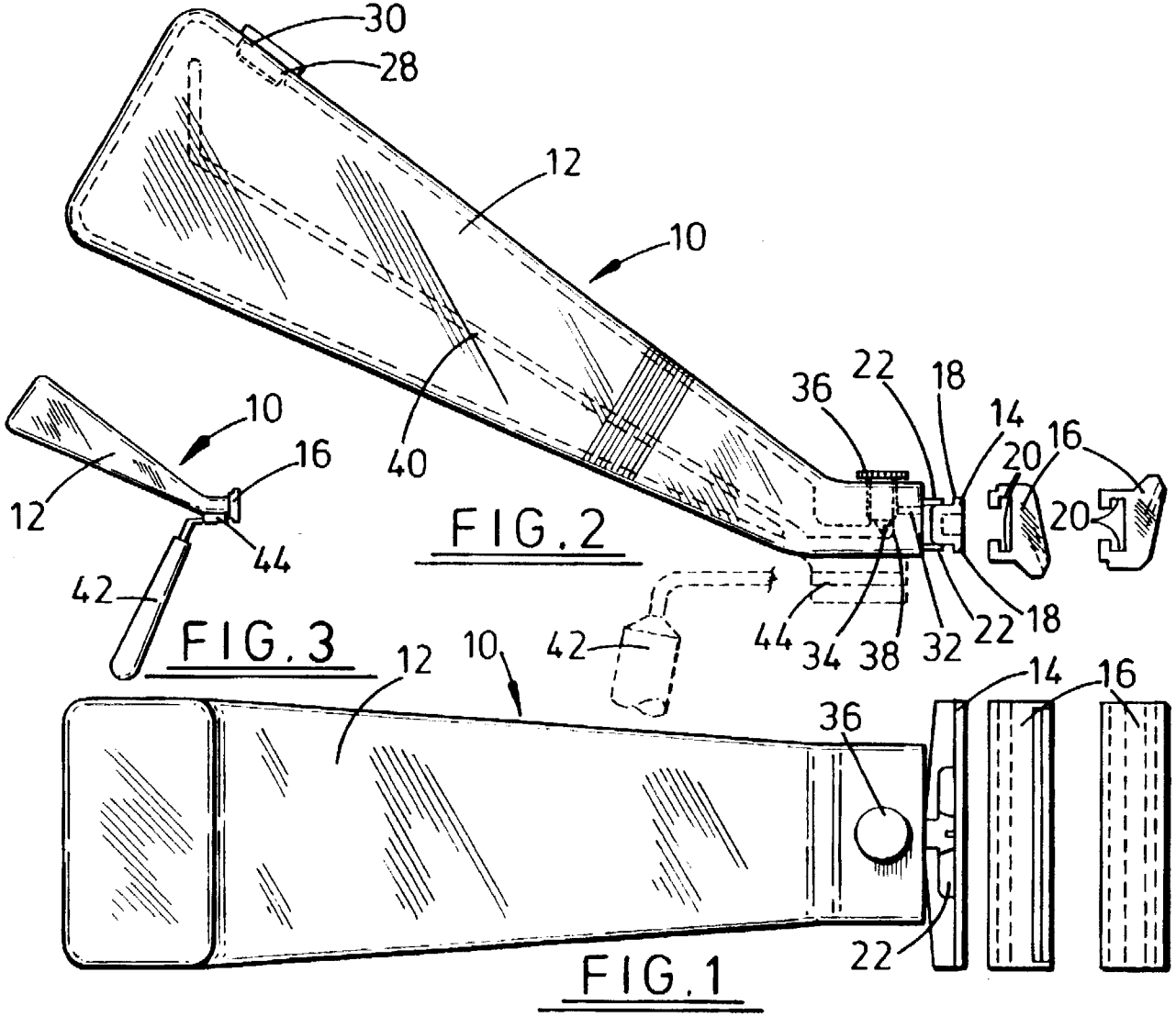
FIG.1 is a front elevation of a first safety razor according to the invention.
FIG. 2 is a side view of the safety razor of FIG. 1.
FIG. 3 is another side view of the safety razor of FIG. 1.

Referring to FIGS. 1 to 3 of the accompanying drawings, a safety razor 10 has a hollow body 12 of resilient material at one end of which is a head 14 to which a razor blade holder 16 with having one or more blades may be coupled. The head 14 has lips 18 along opposite edges thereof which can locate in corresponding grooves 20 of the blade holder 16 by a sliding action so that the blade holder 16 can be coupled in opposite orientations as shown depending on which direction it is intended to use the razor. Resilient members 22 retain the blade holder in place.

The hollow body 12 is wider at its base than at its top where the head 14 is attached and is intended to be a reservoir for water or other lubricating liquid as well as convenient for gripping in the hand or fingers.

A serrated region 26 is actually provided on the outside of the body to facilitate gripping thereof. The body 12 has a filler hole 28 near its base which is sealable by means of a plug 30, which may be vented. The hollow body 12 has at its top a liquid outlet 32 whereby liquid from the body can pass via the head 14 to the blade holder 16. A valve means 34 is provided in the outlet whereby flow of liquid through the outlet may be controlled. The valve means 34 actually comprises a tapered screw member 36 located in a stepped bend 38 of the outlet passage.

Inside the hollow body 12 is a longitudinal baffle 10 which extends from one side of the body 12 to the other. By inverting and turning the body 12, the baffle 40 ensures that most of the liquid in the body is available.

As shown in outline in FIG. 2 and more generally in FIG. 3 an alternative handle 42 may be fitted to a handle location 44 near the top of the body 12. The handle 42 is similar to a conventional plastics safety razor handle and by being angled generally away from the body 12 may be more amenable for so-called "down" stroking, whereas as by gripping the body 12 "up" stroking may be easier.

The additional handle 42 may also allow two handed shaving, which may be easier for someone with an infirmity.

In use the body 12 is filled with water or other shaving lubricating liquid and the valve 34 adjusted so that as the razor is applied to face the liquid can flow onto the face to lubricate the shaving process. The body 12 may be squeezed to assist the flow of liquid. The blade holder 16 itself may be designed such as with closed ends to retain liquid within the shaving area at least for some length of time.

Figure 4:
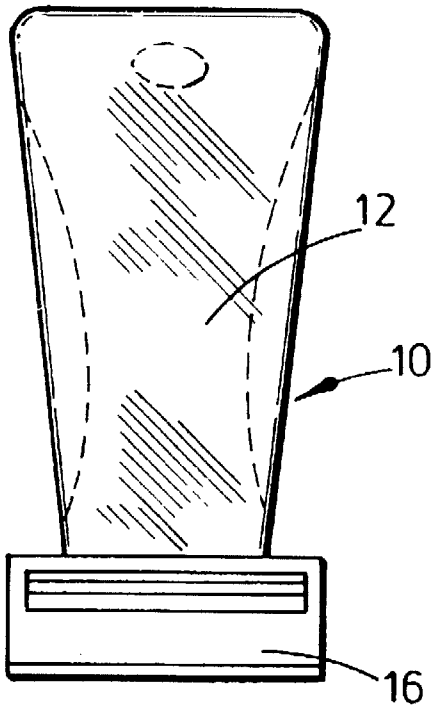
FIG. 4 shows a variation on the safety razor of FIG. 1.

The body 12 is shown to be of a generally tapering shape but may be of any suitable alternative shape such as shown particularly by the broken lines of FIG. 4, wherein the body narrows transversely over its mid-length region.

Figure 5:
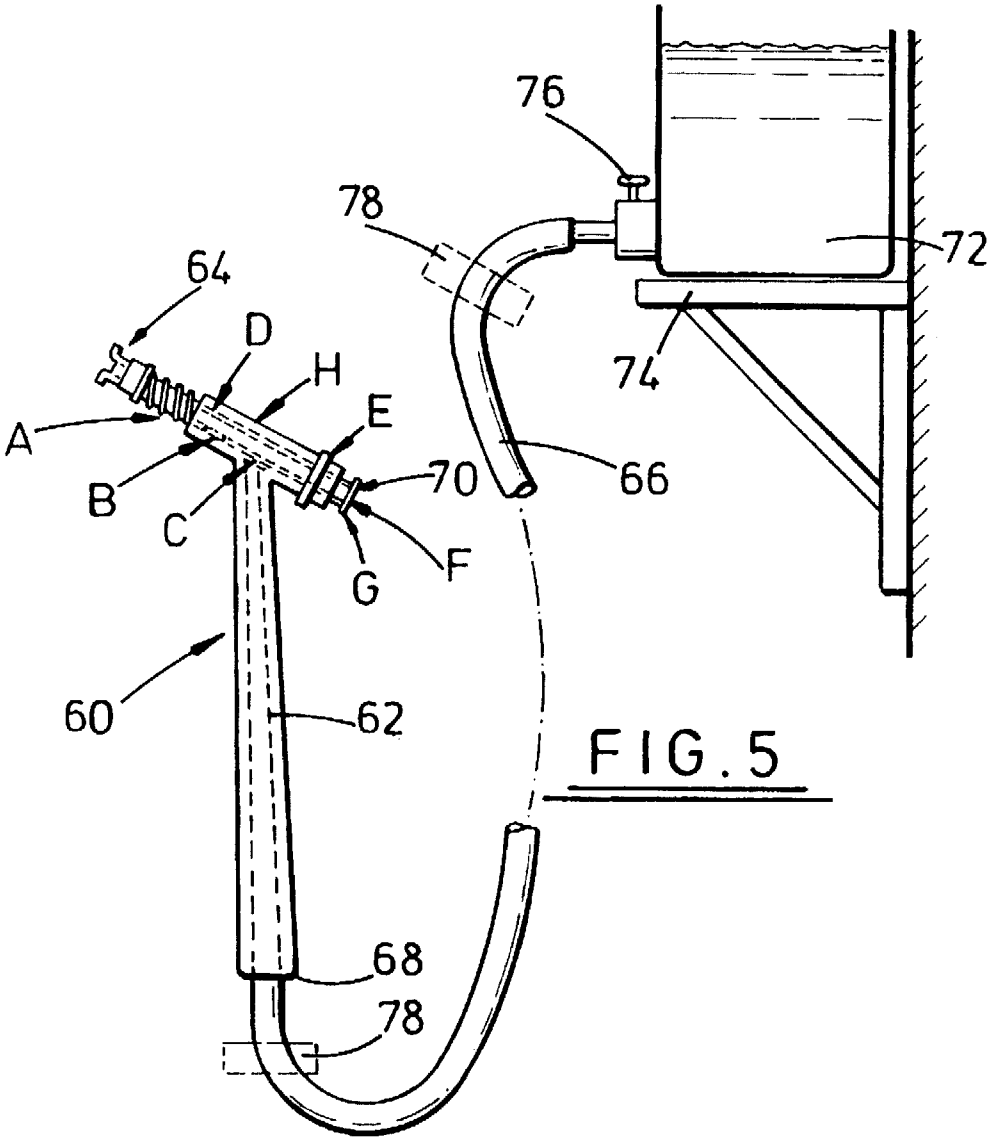
FIG. 5 shows a second safety razor according to the invention.

Turning to FIG. 5 of the accompanying drawings, the provision of shaving lubricating liquid is tackled in a different way to that of FIGS. 1 to 4. In the embodiment of FIG. 5, a more conventional shape of safety razor 60 has a handle 62 with an angled cross-piece 63 and a shaving head 64. The handle 62 is hollow and the shaving head 64 has a communicating passage or passages therethrough. The hollow handle 62 is connected via a flexible tube 66 as shown at its end 68 remote from the shaving head to a lubricating liquid supply tank 72 here shown on a shelf 74. The tank 72 has an on/off tap 76 and one or more flow restriction devices 78 associated with the flexible tube. The tank 72 should be above head height so that gravity will feed liquid to the blade area.

The shaving head is attached to a hollow spindle F through the cross-piece 63. The spindle F is threaded at one end for adjusting nut E, retained by a circlip G and positioned by spring A at its other end between shaving head 64 and the cross-piece 63. Pressure on the shaving head aligns port B of the spindle with aperture C of the handle whence liquid flows to the shaving head and hence the blade. Pressure required is adjustable by means of the nut E which can also override the spring by fully compressing it to leave port B and aperture C permanently aligned. In that case a flow restriction device 78 is used to control liquid supply. Alternatively, the flexible tube 66 may be connected directly to the spindle F at 70, in which case port B may be omitted.

Figure 6:
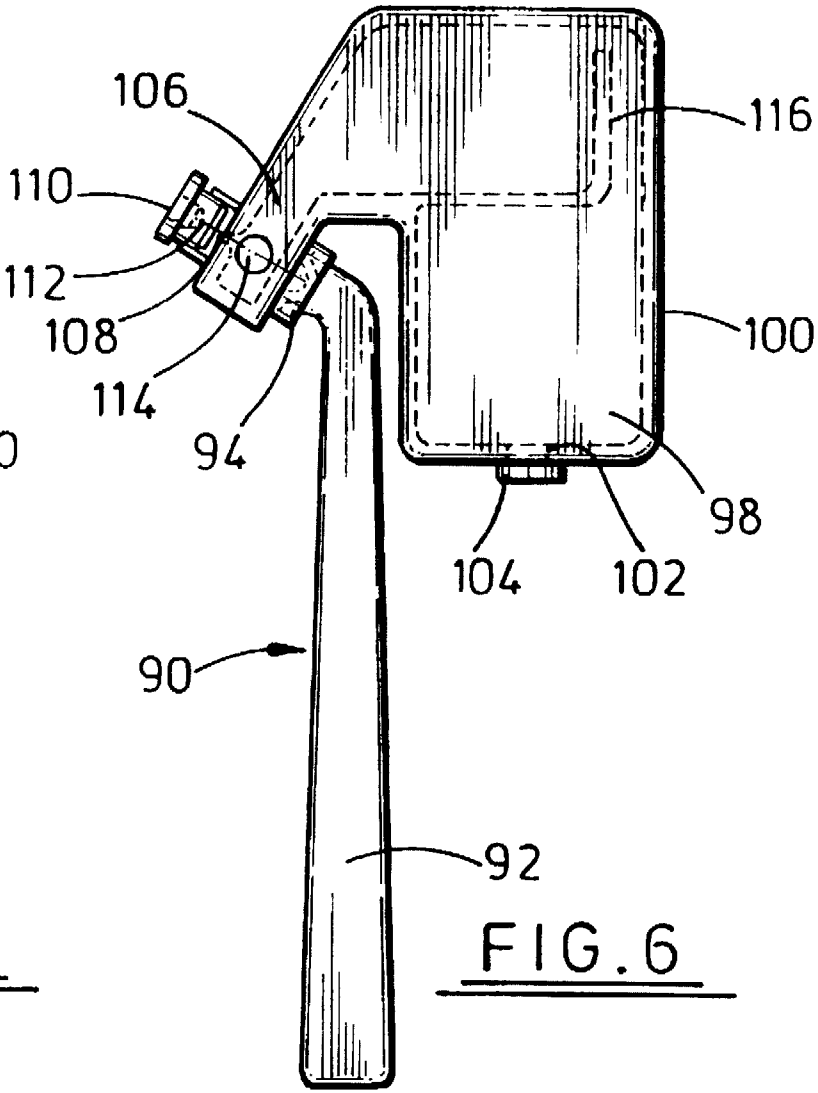
FIG. 6 is a side view of a third safety razor according to the invention.
Figure 7:
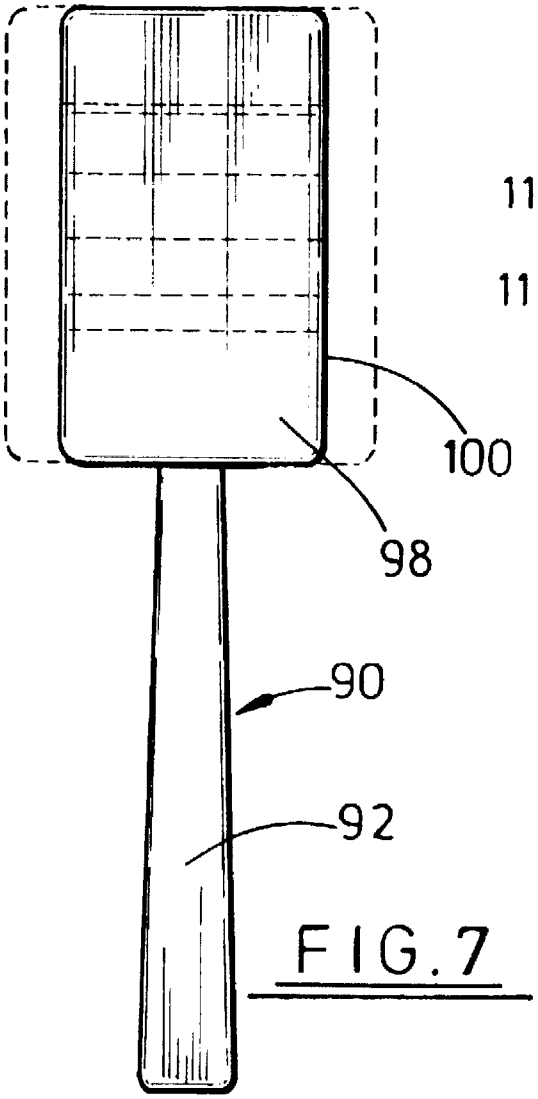
FIG. 7 is a front view of the safety razor of FIG. 6.

Referring now to FIGS. 6 and 7 of the accompanying drawings, a safety razor 90 has a handle 92 with a head 94 at one end for attachment of a shaving lubricating liquid supply container 98. The head 94 may be of conventional type to which a blade holder would usually be attached and the attachment of the container 98 may be in a similar manner.

The container 98 has a main section 100 that is generally rectangular in section and is provided with a filler opening 102 sealable by a plug 104, which may be vented. The attachment of the container 98 to the head 94 is actually to a side extension 106 of the container. That extension 106 has an outlet 108 leading to a blade holder attachment head 110 again similar to that described in FIGS. 1 to 3. The head 110 has one or more apertures 112 therethrough for liquid from the outlet 108 to pass to the blade holder (not shown). A flow restriction valve 114 is also provided just prior to the outlet 108. The valve 114 is similar to the valve 34 of the embodiment of FIGS. 1 and 2 of the accompanying drawings.

Within the container 98 is a baffle 116 extending from the extension side of the container to near its opposite wall and then upwards at 90° to near the upper wall of the container. The baffle 116 serves the same purpose as the baffle 40 of FIG. 2. The device 98 can operate without handle 92.

Figure 8:
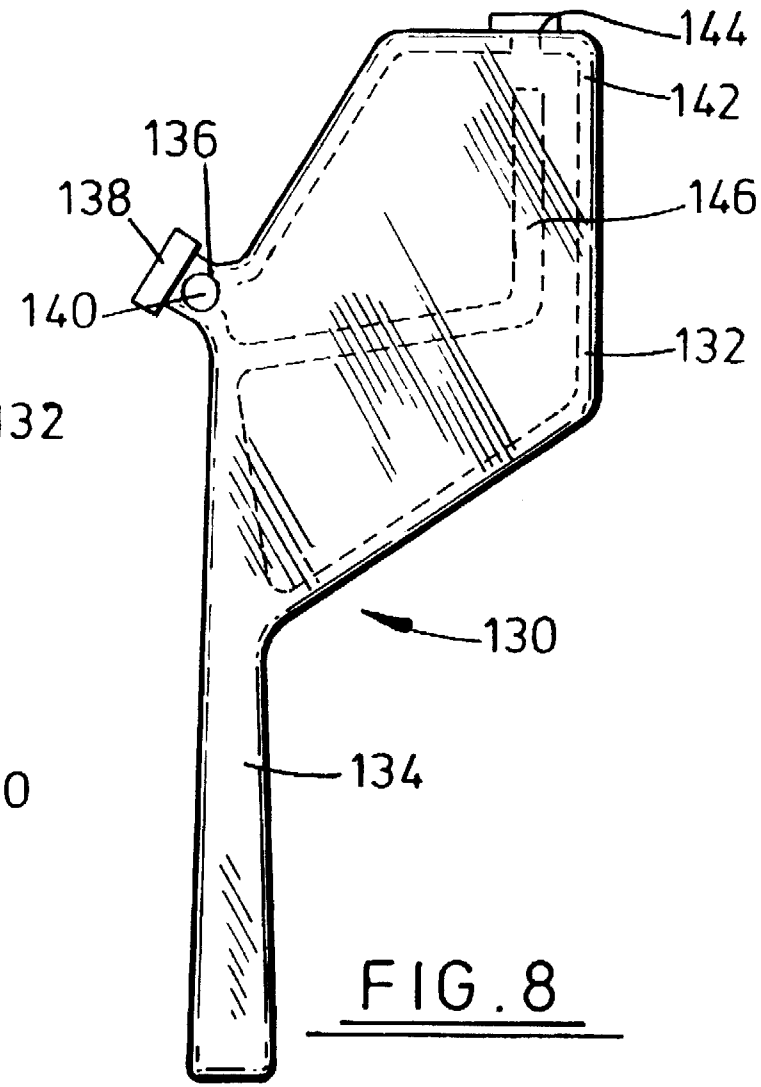
FIG. 8 is a side view of a fourth safety razor according to the invention.
Figure 9:
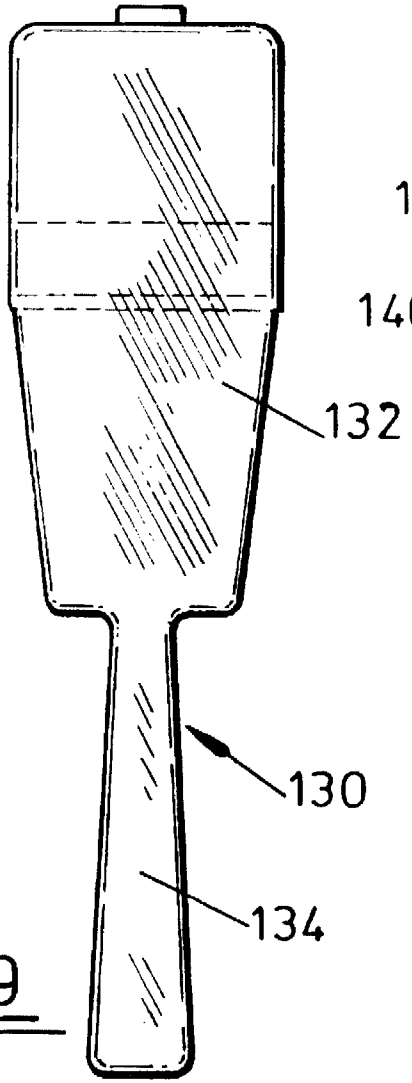
FIG. 9 is a front view of the safety razor of FIG. 8.

The safety razor of FIGS. 6 and 7 is used in the same way as the safety razor of FIGS. 1 to 3. Turning to FIGS. 8 and 9 of the accompanying drawings, a safety razor 130 is illustrated which is similar to that of FIGS. 6 and 7 except that its liquid container 132 is formed integrally with its handle 134. The container 132 has an outlet 136 for directing liquid to shaving head 138 through a liquid flow adjustment valve 140. The container 132 has a filler hole 142 and plug 144 therefor, which may be vented, as well as an internal baffle 146. Again one of the safety razor of FIG. 8 and 9 is similar to that of FIGS. 1 to 3 or of FIGS. 6 and 7.

Figures 10, 12:
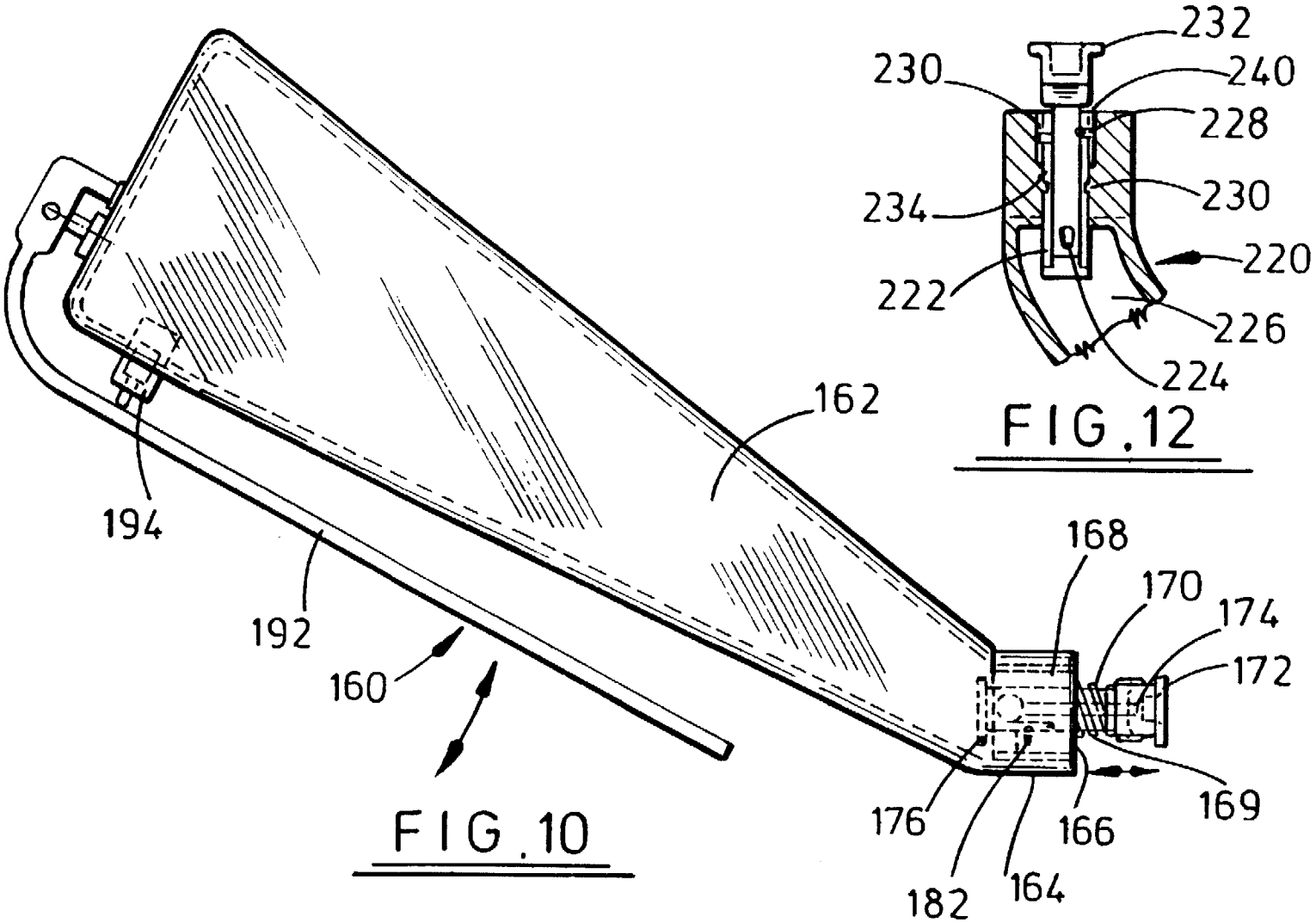
FIG. 10 is a side view of another variation on the safety razor of FIG. 1.
FIG. 12 shows a variation on the safety razor of FIG. 10.
Figure 11:
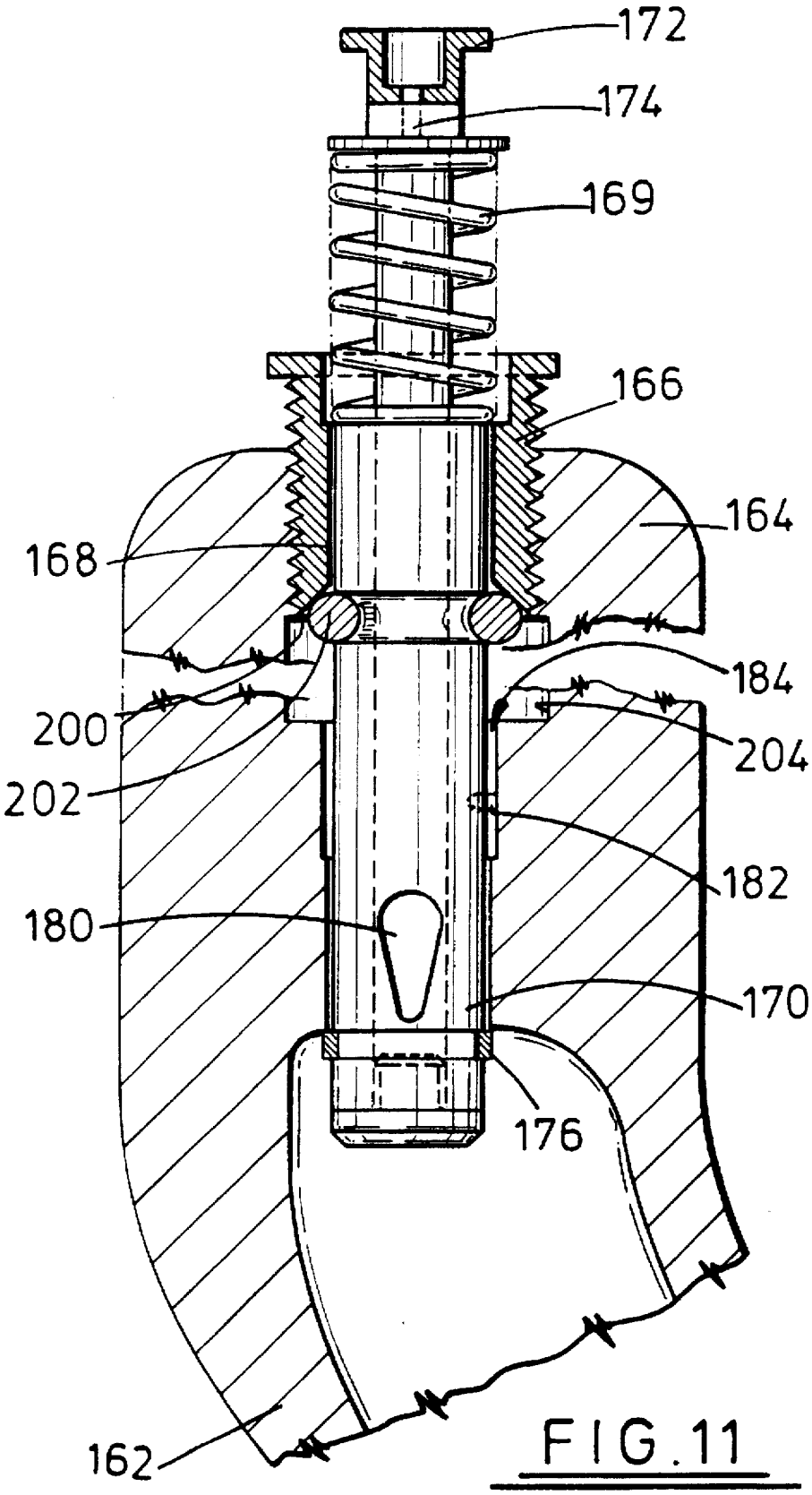
FIG. 11 is an enlarged view of part of the safety razor of FIG. 10.

In FIGS. 10 and 11 of the accompanying drawings there is shown a variation on the safety razor of FIGS. 1 to 3. In this variation generally designated 160, a hollow body 162 similar to body 12 of FIG. 1 has in its neck 164 a screw threaded assembly 166. The assembly 166 has a passageway 168 therethrough in which there is a slidable spring-loaded (see 169) hollow spindle 170. On the outer end of the spindle 170 is a head 172 for receiving a blade holder (not shown). The head 172 has one or more apertures 174 therethrough.

At the opposite end of the spindle 170 is a sealing flange 176 that closes the passageway 168 when spring 178 is extended. The spindle has near the flange a pair of diametrically opposed holes 180 leading to its hollow interior, whereby, when the head 172 is depressed due to a shaving action, the holes 180 are open to liquid in the body 162 which can then pass through the spindle to the head and hence to the blades of the razor.

The assembly 166 further comprises a pin 182 engageable in one or other of a pair of diametrically opposed longitudinal grooves 184 of the inner surface of the handle, whereby the spindle can be rotated through 180° to present the razor blades for an "up" or a "down" shaving stroke.

Instead of relying on gravity feed or even squeezing the body 162 to cause liquid therein to flow to the razor blade(s), pump means may be provided such as shown in FIG. 10 wherein a lever 192 is used to operate a pump 194.

The screw threaded assembly 166 has an internally chamfered end 200 to seat on sealing ring 202 on the spindle 170. The assembly 166 may, therefore, be screwed in further to push the spindle into the handle to expose the apertures 180 to the liquid in the handle. In that way the need for pressure on the spindle via the shaving action may be obviated say when a fresh blade is being used, which is, of course, sharper, so that less pressure is actually exerted on the face during a shaving stroke.

The internal surface of the neck of the handle has an annular recess at 204 to allow for a range of axial movement of the spindle.

Figure 11A:
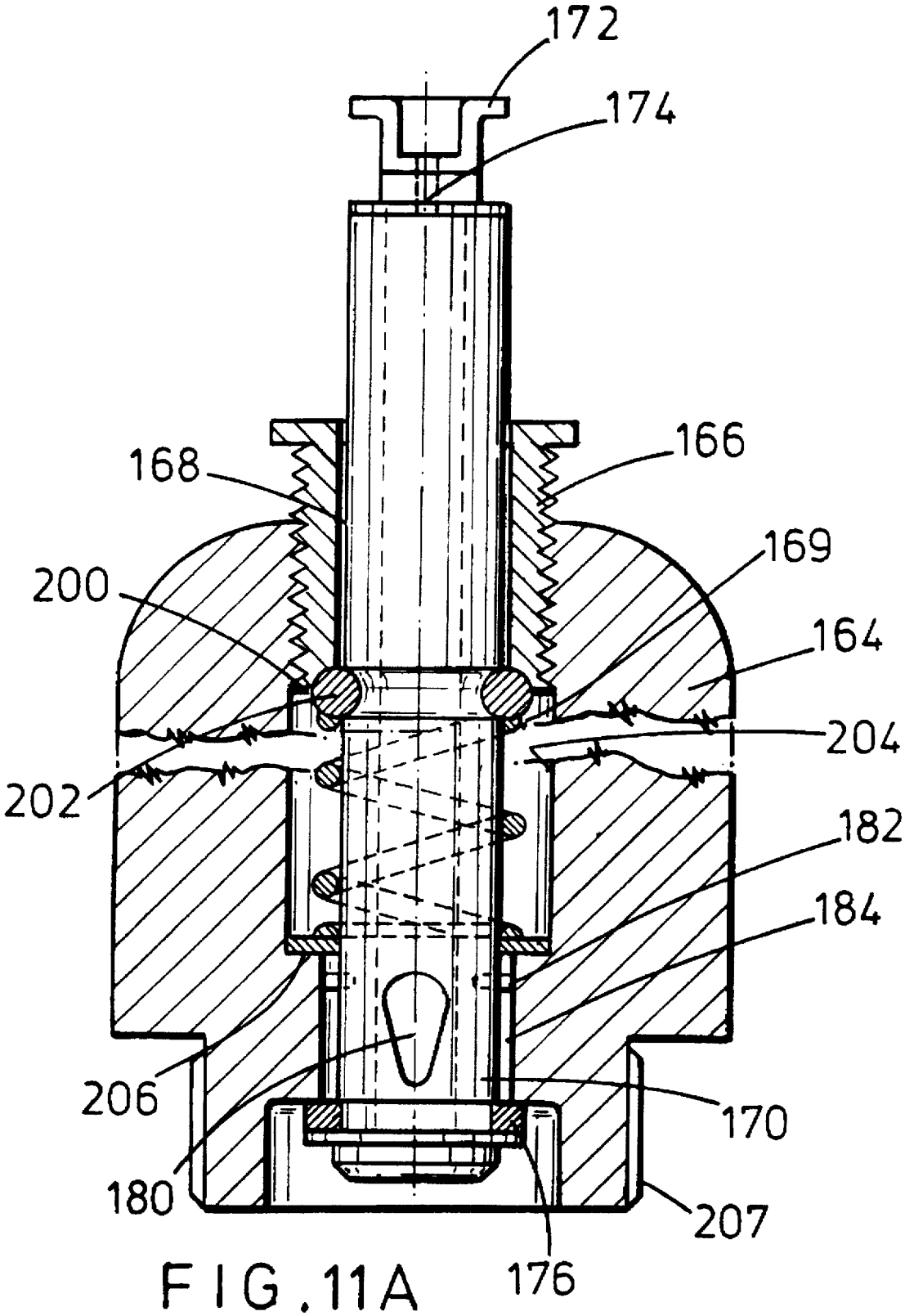
FIG. 11A shows a variation on the embodiment of FIG. 11.

FIG. 11A shows a variation on the embodiment of FIG. 11 which is intended to be a screw-threaded or bayonet type fitting into the neck of a reservoir or harolle. Screw threading is actually indicated at 207*n* and a seal 206 is shown at the bottom of recess 204 around spindle 120.

In FIG. 12 a safety razor 220 is shown which is similar to that of FIGS. 10 and 11. The razor 220 is shown with its spindle 222 depressed to expose aperture 224 in the spindle to liquid in the handle reservoir 226. A pin 228 on the spindle engages one of two annular grooves 230 of the inner surface of the housing depending on whether head 232 of the razor is pulled up to close aperture 224 or pressed down as shown in the drawing.

The spindle 222 also has a pair of longitudinal grooves 234 diametrically opposed again for engagement by the ball 228 allowing the head to be rotated through 180 °.

A variation may be to have cooperating annular grooves and ribs on the spindle and passageway 240 through the neck of the handle so that a variety of relative axial positions for the head may be possible to achieve liquid flow control by partial opening or closing of aperture 224.

Figure 13:
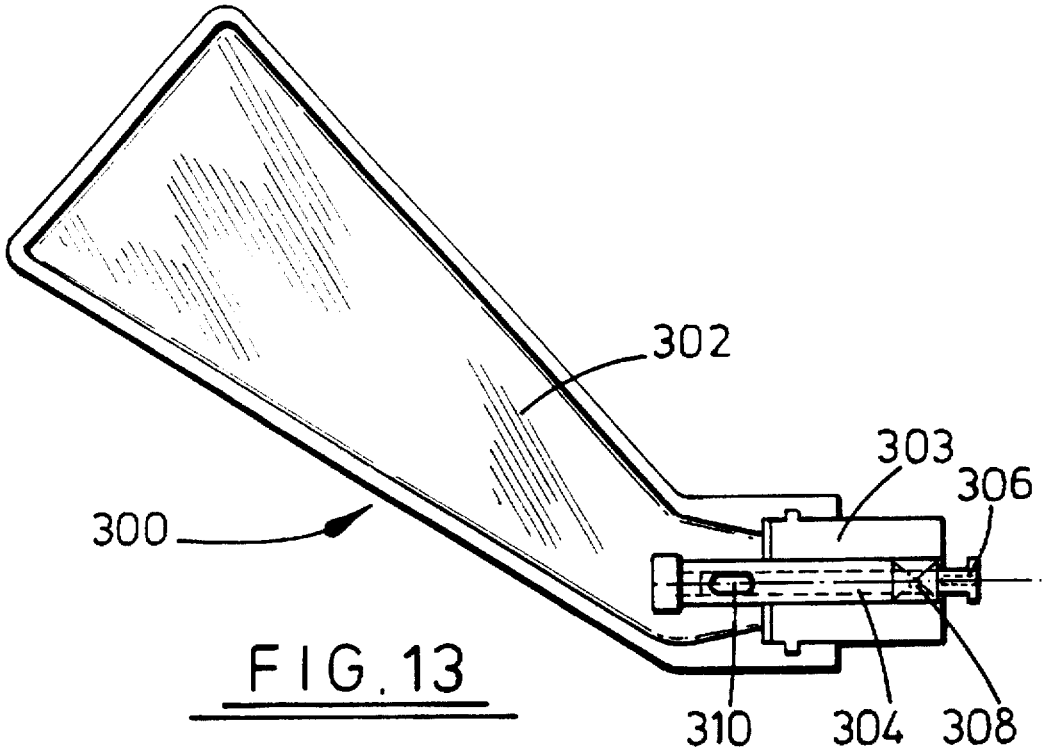
FIG. 13 shows another form of safety razor.

In FIG. 13 there is shown a safety razor 300 having a handle 302 in the form of a liquid reservoir. The handle is angled near its narrower end and in that end is secured a housing 303 for a hollow spindle 304. The spindle 304 has on its outer end a head 306 for attachment of a razor blade or a razor blade holder. The spindle is reciprocable in its housing and has a spring 308 for urging the spindle outwards. At its other end the spindle 304 has an aperture 310 for permitting communication between the reservoir and the head 306, whereby when the spindle is depressed by the shaving action into the reservoir, liquid may flow from the reservoir through the aperture 310 and the hollow spindle 304 to the head 306 to lubricate the shaving process.

Figure 14:
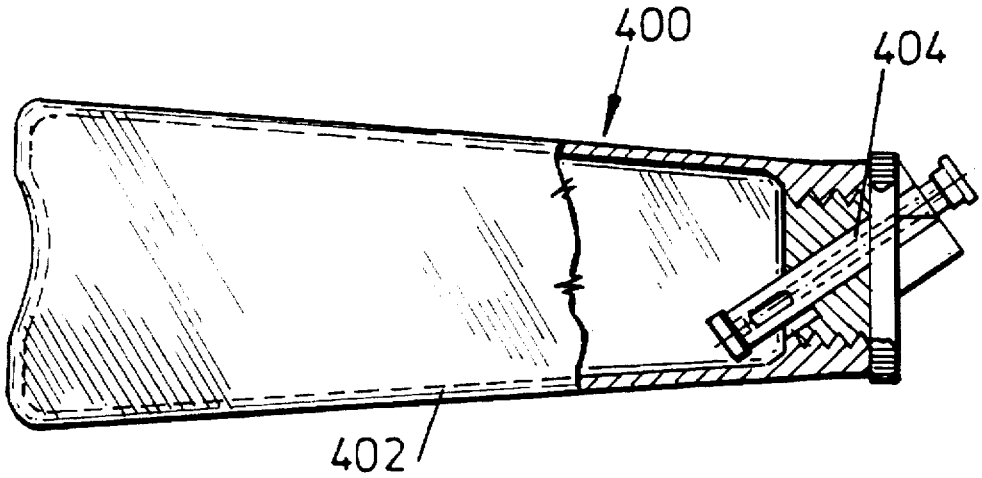
FIG. 14 shows a yet further form of safety razor.
Figure 15B:
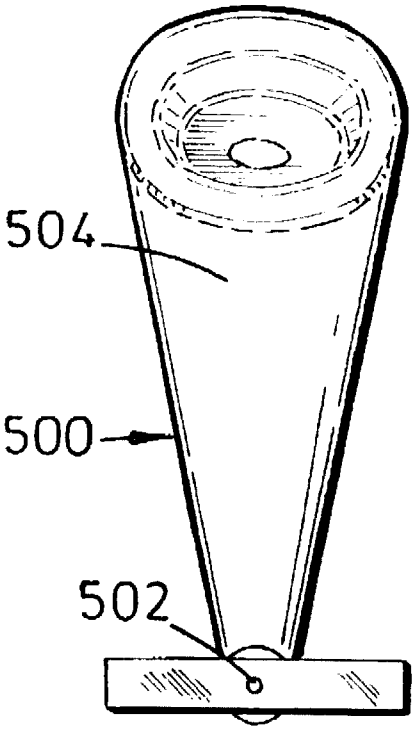
FIGS. 15A & B are section and plan views respectively of another form of safety razor of the invention.

Finally, in FIG. 14 a safety razor 400 has a handle 402 in the form of a liquid reservoir. Contrary to the razor of FIG. 13, the handle is not angled at one end but has its spindle 404 angled relative to the handle to provide a similar shaving angle as is provided by the angling of the handle of the razor of FIG. 13. The razor of FIG. 14 operates in a similar manner to that of FIG. 13.

Figure 16:
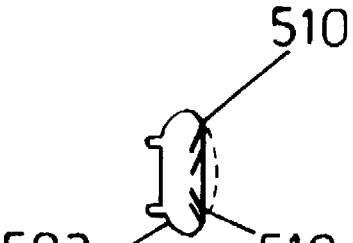
FIG. 16 shows a razor blade holder for use with the razor of FIG. 15.
Figure 15A:
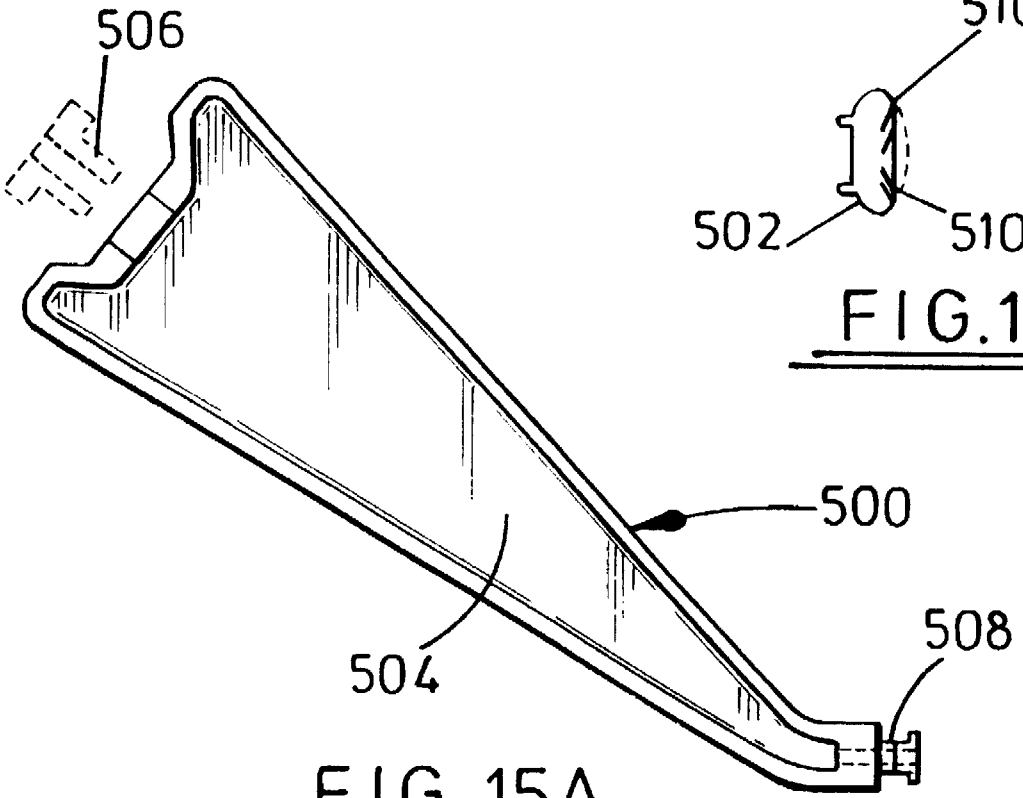

FIGS. 15A and B show a single mould model 500 whereby the need to reverse the blade for upstroke shaping is obviated by the use of a contra-double-bladed cartridge 502 (FIG. 16), which slides over head 508 at one end of reservoir 504. The cartridge has two pairs of contra orientated blades 510. An alternative peripheral shape is shown in broken lines. Variation of the liquid flow from reservoir 504 is governed by the hole diameter in stopper device 506 or removal of the stopper completely for maximum flow.

The reservoir 504 is charged merely by immersing in liquid until full and fitting the cork, if required. For storage upright with liquid remaining in the reservoir, a blank stopper is used. A variation may be to have head 508 detachable for a 180 degrees alternative setting for "upstroke" as in FIG. 13.

It will be appreciated that variations and modifications of the illustrated safety razors may be possible without departing from the spirit and scope of the invention.

I claim:

1. A safety razor for shaving hairs off skin having a handle, a head on the handle and reciprocally movable along an axis relative to the handle from a first outward non-dispensing position to a second inward full dispensing position, a razor blade holder mounted on the head and at least one razor blade in the razor blade holder and a non-pressurized and non-aerosol reservoir for lubricating liquid for shaving, the head having an aperture proximate to the blade holder for dispensing lubricating liquid during shaving, the reservoir forming the handle of the safety razor and the reservoir having an outlet in increasing fluid communication with the head aperture for supplying the lubricating liquid to the head when the head is urged inwardly from the first non-dispensing position progressively toward the second inward full dispensing position, the head being spring-loaded, the spring serving to bias the head outwardly along the axis relative to the handle toward the first non-dispensing position whereby no liquid is normally supplied from the reservoir to the head, the head being reciprocally movable along the axis towards the handle upon application of pressure thereto toward the second liquid dispensing position whereby lubricating liquid is increasingly dispensed from the head of the razor to the skin during shaving by gravity feed from the reservoir to the head as greater pressure is applied to the head thereby enabling lubrication of an area of skin to which the razor blade is being applied.

2. A safety razor as claimed in claim 1, wherein orientation of the at least one razor blade is reversible.

3. A safety razor as claimed in claim 1, wherein the blade holder is a sliding fit with mutually engageable parts of the head of the razor.

4. A safety razor as claimed in claim 1, wherein the blade holder is rotatable about the head of the razor.

5. A safety razor as claimed in claim 1, wherein the reservoir is squeezable.

6. A safety razor as claimed in claim 1, wherein the reservoir includes pump means for augmenting the gravity feed.

7. A safety razor as claimed in claim 1, wherein the blade holder has two pairs of contra-orientated blades.

* * * * *